United States Patent [19]

Luttig

[11] 4,178,671

[45] Dec. 18, 1979

[54] TIE PREPLATING METHOD AND APPARATUS

[76] Inventor: Dale Luttig, Rte. 1, Emmett, Kans. 66422

[21] Appl. No.: 821,666

[22] Filed: Aug. 4, 1977

[51] Int. Cl.[2] ..... B23P 19/04; E01B 29/32

[52] U.S. Cl. ..... 29/429; 29/430; 29/464; 29/791; 29/795; 29/798; 104/16; 104/17 R; 271/250

[58] Field of Search ..... 29/429, 430, 462, 464, 29/428, 798, 795, 791, 281.5; 104/16, 17 R; 271/250

[56] References Cited

U.S. PATENT DOCUMENTS

| | | | |
|---|---|---|---|
| 703,755 | 7/1902 | Bender | 104/16 |
| 2,730,962 | 1/1956 | Wright et al. | 104/16 |
| 2,837,744 | 6/1958 | Newhouse | 29/430 |
| 2,930,328 | 3/1960 | Talboys | 104/17 R |
| 3,701,320 | 10/1972 | Fearon et al. | 104/16 |
| 3,763,547 | 10/1973 | Blakeslee | 29/430 |

*Primary Examiner*—Daniel C. Crane

*Attorney, Agent, or Firm*—Leitner, Palan, Martin & Bernstein

[57] ABSTRACT

A method and apparatus of preplating ties including traversely aligning ties on a path, conveying along the path ties relative to a pair of plate guides, positioning a pair of plates on each tie adjacent the guides, attaching the plates to the tie by partially driving fasteners, continue aligning the plates relative to each other by conveying the tie relative to the guides and securing the plates to the tie during alignment by completing the driving of the fasteners. A tie guide is provided having a fixed guide parallel to the path and a biased pivotal guide extending at an angle to the fixed tie guide.

31 Claims, 8 Drawing Figures

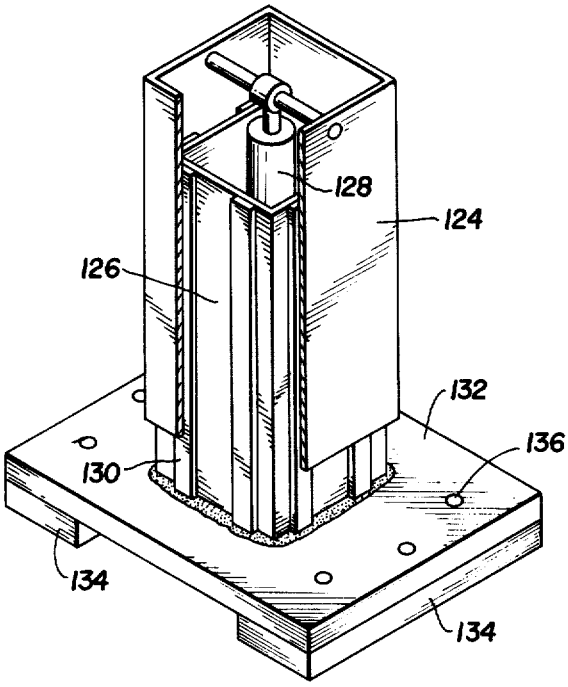
FIG. 6
FIG. 7
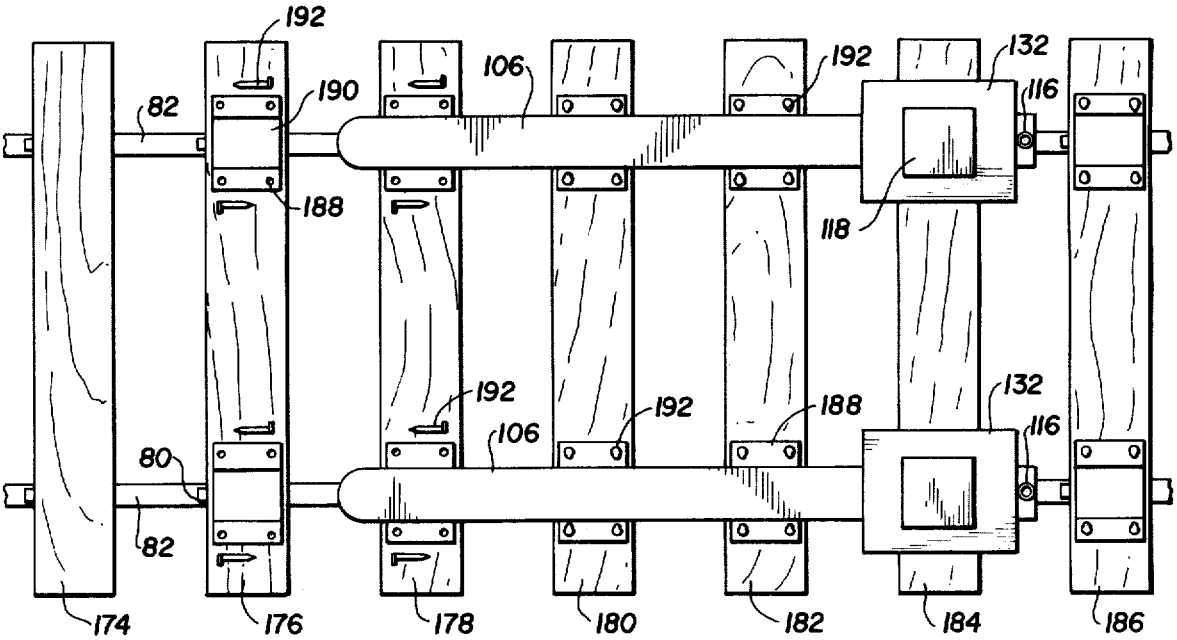
FIG. 8
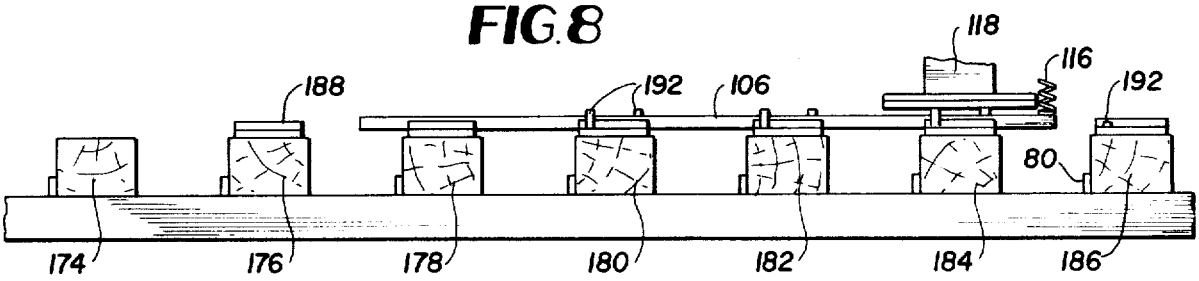

TIE PREPLATING METHOD AND APPARATUS

BACKGROUND OF THE INVENTION

The present invention relates to machines for attaching plates to railroad ties or preplaters.

It is well-known that the two rails of railway track must be accurately aligned with each other to maintain parallelism and accurately spaced to define gauge. One method of achieving the gauge and parallelism uses one prelaid rail as a reference and applies a second rail relative thereto. This was either done by hand or required a carriage rolling on the fixed rail. A typical example of the prior art is U.S. Pat. No. 2,730,962 wherein tie plates are accurately aligned relative to a first laid rail to provide the required gauge and to assure parallelism.

Another method of assuring the gauge and parallelism of the tracks is the method of preplating, wherein the tie plates are secured to the ties before the ties are installed or placed on the ground. The preplaters date from the early manually inserted ties of U.S. Pat. No. 703,755, to a very sophisticated conveying, plating, and laying system of U.S. Pat. No. 3,701,320. A complete system of U.S. Pat. No. 3,701,320 conveys ties having predrilled holes in a first path to receive plates having spikes pending therefrom in a second path so as to intersect placing the spikes and plates in the predrilled holes. The assembled tie and plate are then secured by a hammering station and transmitted further down the line. Other preplating systems presently available include feeding and transporting the tie lengthwise through a hammering station, securing a first plate, and then manually measuring the gauge before securing the second plate.

An older philosophy of determining gauge is illustrated in French Pat. No. 91,796 wherein the tie is conveyed to a station wherein a pair of notches are formed to receive the tie plates and holes are drilled for the spikes.

Assessment of the prior art reveals a need for a mechanically simple preplating apparatus which can accurately align, space, and secure a pair of plates to a tie to assure the gauge and parallelism of the tracks to be placed therein and is capable of operating at a high speed.

SUMMARY OF THE INVENTION

The present invention provides a method and apparatus of applying a pair of plates of a tie at high speed while maintaining the accuracy of spacing and parallelism of the plates. The method begins with placing ties on a conveyor to travel widthwise down the conveyor. The ties have their position adjusted transversely on the conveyor to accurately position them thereon. A pair of plates are placed upon each tie and travel into a pair of guides which accurately align the plates relative to each other to achieve the gauge and parallelism of the plates. Fasteners are initially started into the tie through the plates. The tie with the plates thereon then travel along the guides to a hammering station. The guide, which extends through the hammering station, firmly holds the pair of plates aligned and biases them towards the tie so as to be accurately aligned at the driving station wherein the driving of the fasteners is completed to secure the plates as accurately aligned to the ties.

The apparatus includes a frame to which all the elements are attached. A tie guide is provided at the entrance to the conveyor which includes a fixed or stationary tie guide and a pivotally connected tie guide at an angle relative to the fixed tie guide. The pivotal tie guide is biased so as to rotate towards the fixed tie guide and includes a stop to limit the minimum distance between the closest portion of the pivotal tie guide and fixed tie guide to less than the length of the tie to be transported on the conveyor. A pair of plate guides, parallel to each other and to the conveyor path, extend along the conveyor path and through the hammering station. Plates positioned on the ties travel along the plate guide so as to be initially aligned and attached to the tie and to be held aligned and fixed to the ties in the hammering station. The portion of the plate guides extending through the hammering station is bias so as to hold the plates securely against the ties at the hammering station. The hammering station includes a pair of hammer devices which are designed so as to be continuously horizontal irrespective of the position or number of fasteners to be finally driven into the ties through the plates. A position indicator descending down from the frame allows the operator at a first control station to stop the conveyor, accurately positioning the tie and plates thereon below the hammering station and to activate the hammering devices. A second control position, remote from the first control station, includes controls for the conveyor. The exit section of the conveyor is adjustable vertically to provide different exit delivery heights.

OBJECTS OF THE INVENTION

An object of the present invention is to provide a tie preplating machine which can operate at high speed while maintaining accuracy of the alignment of the plates.

Another object is to provide a mechanically simple machine so as to extend the operating life thereof and allow repair in the field.

A further object of the invention is to increase the speed of tie preplaters by minimizing the number of automatic operations and making maximum use of manual labor.

Still another object of the invention is to assure accurate alignment of the plates relative to each other by alignment during securement of the plates to the ties.

A still further object is to provide an improved tie traverse alignment device for conveyors.

Other objects, advantages, and novel features of the present invention will become apparent from the following detailed description of the invention when considered in conjunction with the accompanying drawings.

BRIEF DESCRIPTION OF THE DRAWINGS

FIG. 6 is a cutaway perspective elevation of the hammering device.

FIG. 7 is a plan view schematic representation of the method of the present invention.

FIG. 8 is a side elevation of the method illustrated in FIG. 7.

DESCRIPTION OF THE PREFERRED EMBODIMENTS

Figures 1, 2:
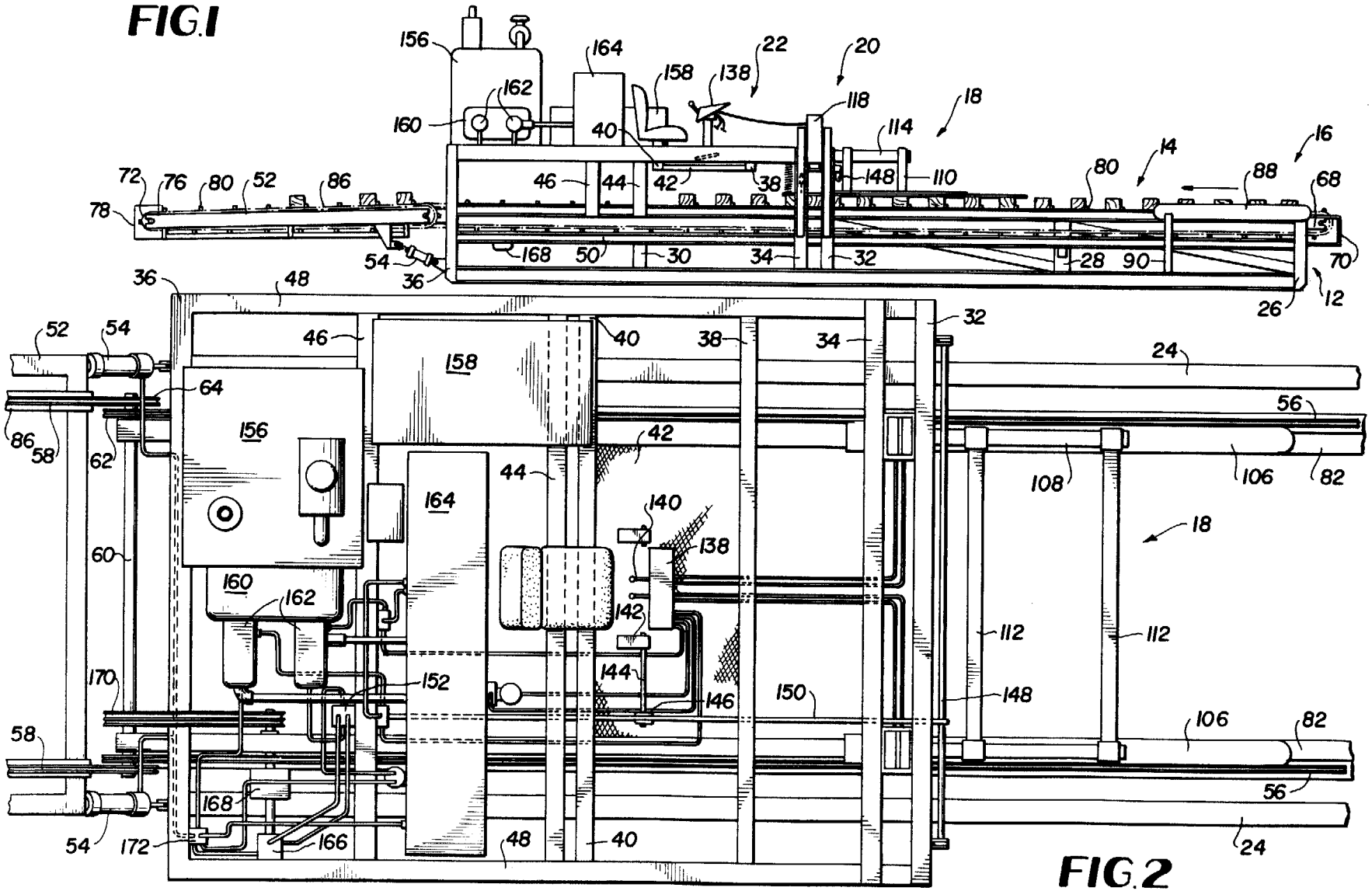
FIG. 1 is a side elevation of a preplating apparatus embodying the principles of the present invention.
FIG. 2 is a plan view of the apparatus of FIG. 1.

FIGS. 1 and 2 illustrate the preferred embodiment of the tie preplater 10 having a frame 12, conveyor 14, tie guide sections 16, plate guide section 18, hammering section 20, and controls 22.

The frame 12 includes a pair of base frame members 24, to which are mounted conveyor lateral frame elements 26, 28, and 30 and lateral conveyor and control platform frame elements 32, 34, and 36. The control platform frame includes additional lateral platform supports 38 and 40 with a grading 42 attached and lateral supports 44 and 46. The control platform frame also includes longitudinal frame elements 48 and 50. The rear or exit frame 52 is pivotally mounted to the platform lateral frame element 36 and is driven by a pair of cylinders 54 to adjust the position of the rear frame 52 for different delivery heights of the preplated ties.

The conveyor system 14 includes a first pair of chains 56 and a second or a rear pair of chains 58 driven off a common shaft 60 by respective sprockets 62 and 64. The other end of chains 56 ride over front sprockets 65 which are mounted to shaft 66 which is journaled into supports 68. Chain guards 70 are mounted to lateral frame element 26 as is shaft support 68. Similarly the other end of chains 58 ride over sprockets 72 which are mounted to shaft 74 which is journaled into supports 76 having guards 78 both of which are mounted to rear frame 52. Chains 56 and 58 have a plurality of vertical extensions 80 which engage the rear surface of the ties and conveys them along the frame. Chains 56 advance along tie supports 82 and return riding upon lower longitudinal supports 84. Rear chains 58 are advanced along tie supports 86. By using a single drive for all the chains and extensions 80 for engaging the ties, the ties move uniformly along the conveyor path and consequently are not misaligned during conveying nor during the subsequent plate alignment and securement as to be described below.

Figure 3:
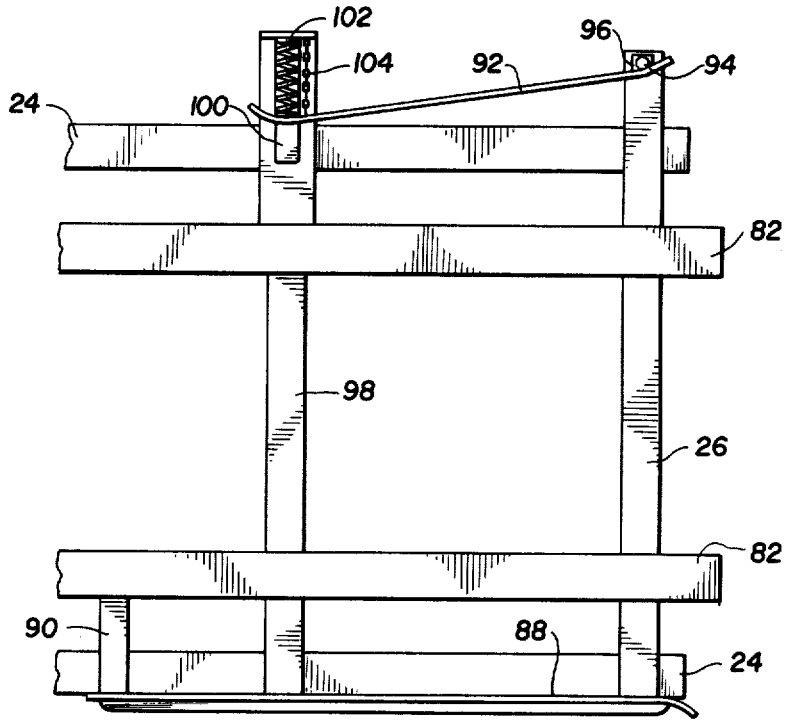
FIG. 3 is a plan view of a tie guide embodying the principles of the present invention.

The tie guide section 16, as illustrated in detail in FIG. 3, includes a fixed or stationary end guide 88 secured at one end to lateral frame element 26 and at the other end to tie support 56 and base frame member 24 by bracket 90. Opposite stationary end guide 88 is a movable end guide 92 pivotally connected to frame element 26 by post 94 and bracket 96. The other end of movable end guide 92 rides along support 98 which includes a wear plate 100. A biasing means 102, which is illustrated as a spring, biases the end of movable end guide 92 towards the stationary end guide 88. Guide 92 at all times forms an angle relative to the fixed tie end guide 88. A stop means, which is illustrated as a chain 104, also being attached to support 98, limits the travel of the movable end guide 92 and defines the minimum separation distance between the closest portion of movable end guide 92 and the fixed end guide 88. Chain 104 may be adjusted such that the minimum distance is less than the length of the tie. Preferably, this distance is three inches less than the tie length. The spring 102 has been designed to accommodate eight and up to nine foot length ties, but any lengths of ties may be accommodated with the proper design.

By having end guide 92 at an angle, the ties, which are placed on the conveyor, are forced towards the fixed end guide plate 88. By having end guide 92 pivotally biased, the pair of end guides 88 and 92 may accommodate varying length ties without adjustment while assuring that one end of the tie will always be against guide 88 which is fixed and parallel to the conveyor. Also, by including a stop chain 104 to define a minimum separation distance less than the minimum length tie, the guides 88 and 92 are self-compensating for wear and tear and other mechanical difficulties of prior art tie guide devices.

Figure 4:
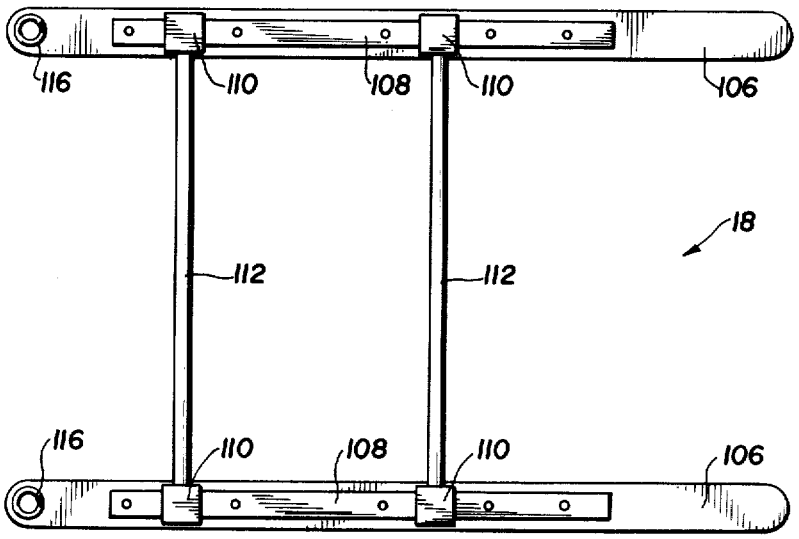
FIG. 4 is a plan view of the plate guide section of the apparatus of FIG. 1.

The plate aligning or guide section 18, as illustrated in detail in FIG. 4, includes a pair of guides 106 mounted to reinforcing bars 108 by fasteners. The reinforcing bars 108 are welded to hangers 110 which are separated by braces 112. The hangers 110 are mounted to lateral frame element 32 by support elements 114. A spring 116 connected to the rear portion of each guide 106 and frame element 34 biases the rear portion down towards the conveyor. These springs are specifically illustrated in FIG. 5.

By mounting the guides 106 to reinforcement bars 108 by removable fasteners, the guides 106 may be removed and replaced with other guides. The importance of the replacement of guides 106 is that the guides corresponding to the specific width of rail seat which corresponds to the width of the base of the rails can be provided. Since the present invention uses guides 106 to ride in the rail seat portion of the plates to align the plates relative to each other to guarantee parallelism of the plates, the width of the guides 106 must correspond to the width of the rail seat in the plate.

It should be noted that although the gauge or separation of the guides 106 is shown as fixed, since all rail presently used is of a fixed gauge, obviously the guide supports may be made adjustable if different gauges are used in the future as was true in the past. As illustrated in FIG. 1, the plate guides 106 extend parallel to the path of the conveyor traversing and extending through the hammering section 20. The spring 116 at the hammering section 20 allows the guide 106 to be forced down against the plates to securely hold the plates against the tie during the hammering operation. This eliminates any misadjustment during hammering since the guide traverses and holds during this operation.

Figure 5:
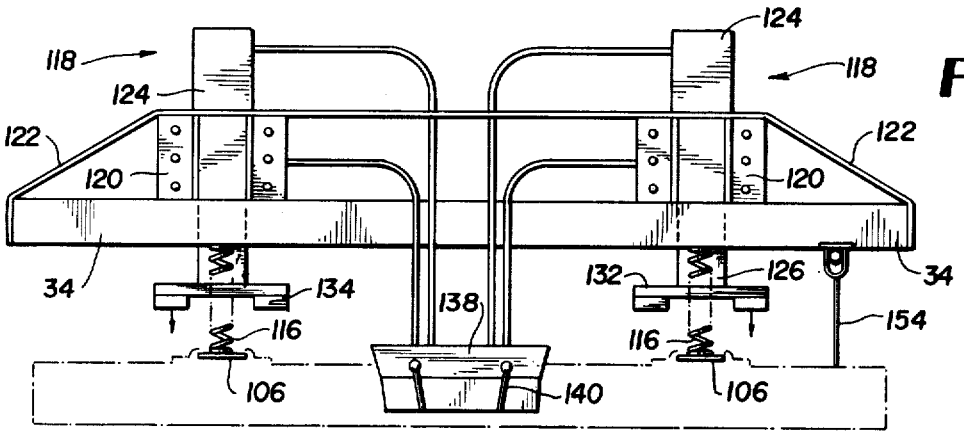
FIG. 5 is an end elevation of the hammering station of the apparatus of FIG. 1.

The hammering section 20, as illustrated in detail in FIGS. 5 and 6, includes a pair of hammers 118 secured between lateral frame elements 32 and 34 by brackets 120 and straps 122. Hammer 118, as illustrated in FIG. 6, includes an exterior guide 124 and an interior guide 126. A piston cylinder 128 is connected at opposite ends to guides 124 and 126 so as to determine the position of the two guides relative to each other. A plurality of wear plates 130 are mounted to interior guide 126 so that the interaction betweeen guides 124 and 126 are along the wear plates 130. Preferably, a lubricant is placed on the wear plates 130. Mounted to the lower end of interior guide 126 by welding is a plate 132. A pair of hammer faces 134 are secured to plate 132 by fasteners 136. The spacing of hammering faces 134 correspond to the position of the spikes or fasteners which are to secure the plate to the tie. By using telescopic guides 124 and 126, the plate 132 and consequently the hammer faces 134 remain continuously horizontal during driving irrespective of the number or placement of the spikes or fasteners. The force produced by the piston cylinder is sufficient so as to engage the fastener and force it into the tie at a slow rate without impact. This method of hammering assures driving of the spike perpendicular to the tie and does not produce any misalignment and/or force between the spike and the tie plate as a result of spike misalignment.

Control section 22 includes a first control panel 138 having a pair of levers 140 each for controlling one of the hammers 118. Adjacent control panel 138 is a foot pedal 142 mounted to shaft 144 which is connected to linkage 146. Mounted to the front of lateral frame element 32 is a control bar 148 which provides a second control position remote from control panel 138. Rob 150 connects bar 148 and foot pedal 142 via shaft 144 and linkage 146 to valve 152. Either the foot pedal 142 or the bar 148 controls valve 152 so as to direct the conveyor mechanism to move forward, reverse or stop. Because of the mechanical linkage 146, activation of bar 148 can override foot pedal 142 and vice versa. Bar 148 is considered a safety control wherein a person adjacent the conveying line may stop or otherwise control the conveyor for his own safety and override the control of an operator at foot pedal 142.

An indicator or optical guide 154 is secured to frame element 34 so as to provide an optical alignment for the operator at control panel 134 of the tie relative to the hammers 118 so that the operator may stop the conveyor with a tie and tie plates thereon directly under the hammers 118. In normal operation, the operator using pedal 142 controls the conveyor to advance ties. Once a tie is adjacent optical indicator 154, the operator releases the pedal 142 so as to stop the conveyor with the tie and tie plates under the hammers 118. Then the operator moves control levers 140 to activate the hammers 118 to drive the spikes to finally secure the plates to the ties. Upon release of levers 140, the operator reactivates the conveyor by foot pedal 142 to advance the ties.

The power plant and control of preplater includes a diesel motor 156 having a fuel tank 158 and a gear box 160. Hydraulic vane pump 162 are connected to the gear box and are hydraulically connected to hydraulic reservoir 164. Hydraulic valve 152 which controls the conveyor feeds hydraulic motor 166. The output of the motor 166 drives shaft 60 through gear box 168 and sprockets and chains 170. Hydraulics are also connected to control panel 138 which is hydraulically connected to the piston cylinders 128 of the hammers 118. Additionally, a control 172 is mounted to rear frame 36 to control the hydraulic cylinders 54 which adjust the position of the rear frame 52. Appropriate filters and pressure regulators are included to provide the appropriate control and will not be described in detail. The hydraulic controls are considered state of the art and are not considered part of the invention. The only significance of the use of hydraulics versus pneumatics is that the present control system can be operated in any environment, including very cold temperatures.

METHOD OF OPERATION

The method and operation of the apparatus described in FIGS. 1 through 6 will now be detailed relative to the schematic representation of FIGS. 7 and 8. A plurality of ties 174 through 186 are illustrated as being transported or conveyed along tie supports 82. Ties are placed on the conveyor either manually or by separate apparatus and guided or adjusted transversely on the conveyor by guides 88 and 92 as illustrated in FIG. 3. An aligned tie 174 is shown in FIGS. 7 and 8. As the ties move along the conveyor tie plates 188 are manually positioned on the ties and a pair of fasteners 192 are also placed adjacent the tie plates 188 as illustrated for tie 176. As the ties and the tie plates, which are carried thereon, approach plate guide 106, the plate guides 106 align the plates relative to each other on the ties as illustrated for tie 178. Once the plate guides 106 engage the rail seat 190 of the plates 188, fasteners or spikes 192 are manually started into the the ties through apertures in the plates 188. As can be seen in FIG. 8 for ties 180 and 182, the spikes 192 are merely started and not fully driven therein to hold the plates 188 more securely to the ties and to position spikes for hammering.

Once the tie is directly under the hammers 118 and is visually detected by the use of indicator 154, the operator at the control panel 138 stops the conveyor by using foot pedal 142 and activates the pair of hammering devices 118 by levers 140. Once the hammering operation is complete, levers 140 are released raising the cylinder and hammering faces and the conveyor is reactivated to transport completed tie for example 184 from the hammering section and to bring a new tie thereunder. The completed tie, as illustrated by tie 186, has the fasteners or spikes 192 completely driven so as to secure the aligned plates 188 to the ties. As discussed previously, plate guides 106 extend through the hammering section and include springs 116 to bias the guides down against the plates and the tie so as to securely hold the plates aligned relative to each other during the completion of the driving of the spikes or fasteners.

The preferred embodiment of the present apparatus and method does not use predrilled ties. To use such ties, the spikes 192 need merely be placed through the plates 188 into the predrilled holes. If the predrilled holes should not be properly drilled, then any misalignment between the predrilled holes and the position produced by guide 106 will produce a secure plate having residual forces and the spikes will be driven in at an angle relative to the plate creating residual forces. The capacity of hammers 118 are sufficient to drive spikes securely into the ties without the use of predrilled holes.

From the preceding description of the preferred embodiments, it is evident that the objects of the invention are attained. The present invention requires many manual steps, and obviously automatic or machine performance of these steps may be included though not preferred. For example, the ties may be automatically fed onto the conveyor, the spikes 192 may be automatically started and other obvious modifications. The present apparatus and method as described has a high speed capability producing at least four preplated ties per minute which is well above the capacity of present devices in the market. By reducing the number of moving parts and automatic mechanisms and limiting them merely to the conveyor and hammer means, the high speed is possible and the longevity and useful life of the machine is extended. Also, by reducing the number of parts, the apparatus may be repaired in the field, which is usually some remote location, by any person having a rudimentary understanding of machinery. The rigid guides 106 assures the accuracy of alignment of the plates relative to each other after many hours of operation. Similarly, the removability of guides 106 allows them to be easily replaced due to wear and tear as well as to provide for different widths of track seats 190.

Although the invention has been described and illustrated in detail, it is to be clearly understood that the same is by way of illustration and example only and is not to be taken by way of limitation. The spirit and scope of this invention is to be limited only by the terms of the appended claims.

I claim:

1. A tie preplater for aligning and securing a pair of rail plates to a rail tie comprising:

means for conveying rail ties along a path;

means along said path for aligning the rail seat of a pair of rail plates relative to each other while positioned on a moving respective rail tie; and means along said path for securing said aligned rail plates to said rail tie by fasteners.

2. The tie preplater according to claim 1 wherein:

said conveying means transport said rail ties widthwise;

said rail seat aligning means includes a pair of guides laterally spaced along said path for determining the gauge of the rail seats; and said securing means includes a pair of means for driving fasteners into said rail plates and rail tie.

3. The tie preplater according to claim 1 wherein said rail seat aligning means includes a pair of guide means parallel to and laterally spaced along said path for engaging and aligning said rail seats on a rail tie.

4. The tie preplater according to claim 3 wherein said guide means extend through said securing means along said path to maintain alignment of said rail seats at said securing means.

5. The tie preplater according to claim 4 including means for resiliently biasing the portion of said guide means at said securing means towards said rail tie to hold said rail plate fixed on said rail tie during securing.

6. The tie preplater according to claim 3 wherein said securing means includes a pair of means for driving fasteners into said rail plates and rail tie.

7. The tie preplater according to claim 6 wherein said driving means includes a hammer means for engaging fasteners extending from said rail tie and means for maintaining the face of said hammer means horizontal during driving irrespective of the position of said fasteners.

8. The tie preplater according to claim 3 wherein said rail seat aligning means aids the positioning of the rail plates during the initial attachment of said rail plates to a rail tie.

9. The tie preplater according to claim 1 including guiding means for aligning transversely said rail ties on said conveying means before said rail seat aligning means along said path.

10. The tie preplater according to claim 9 wherein said rail tie guiding means includes a first guide parallel to said conveying means and a second guide opposite said first guide and at an angle to said first guide for guiding a rail tie toward said first guide.

11. The tie preplater according to claim 10 including means biasing the end of said second guide nearest said first guide toward said first guide.

12. The tie preplater according to claim 11 including stop means for defining the minimum separation of said first and second guides less than the length of said rail tie.

13. The tie preplater according to claim 1 wherein said conveying means includes an exit portion after said securing means along said path which is vertically adjustable.

14. The tie preplater according to claim 1 including:

a first control station including manual controls for said conveying means and said securing means; and a second control station remote from said first control station including a manual control for said conveying means.

15. The tie preplater according to claim 14 including means for indicating to said first control station a rail tie is aligned with said securing means whereby said conveying means may be deactivated and said securing means may be activated.

16. The tie preplater according to claim 14 wherein said first and second control station can control said conveying means for stopping and for conveying in either direction along said path.

17. In a tie plater having means for conveying rail ties, means for guiding rail ties and means for securing rail plates to the rail ties, the improvement comprising:

a pair of means for aligning the seats of a pair of rail plates relative to each other while said rail plates travel with a rail tie on said conveying means to said securing means.

18. The tie plater according to claim 17 wherein said aligning means are parallel to and laterally spaced along said conveying means.

19. The tie plater according to claim 17 wherein said aligning means aids the positioning of the rail plates during the initial attachment of said rail plates to a rail tie.

20. The tie plater according to claim 17 wherein said aligning means extends through said securing means to maintain rail seat alignment during securing.

21. The tie plater according to claim 20 including means for resiliently biasing the portion of said guide means at said securing means towards said rail tie to hold said rail plate fixed on said rail tie during securing.

22. The tie plater according to claim 17 wherein said aligning means include a support and a guide removably mounted to said support.

23. The tie plater according to claim 22 wherein said conveyor means transports the rail seat of said rail plates along said guides and said guides have a width corresponding to the width of said rail seat.

24. A method of securing a pair of rail plates to a rail tie comprising:

conveying said rail tie along a path;

positioning a pair of rail plates on said rail tie;

temporarily attaching said positioned rail plates to said rail tie to travel thereon;

aligning the rail seat of said rail plates relative to each other on said rail tie during the conveying of said rail tie; and securing said aligned rail plates to said rail tie.

25. The method according to claim 24 wherein said attaching includes partially driving fasteners into said rail tie through openings in said rail plates and securing includes completing the driving of said fasteners into said rail tie.

26. The method according to claim 25 wherein said aligning includes conveying said rail seats of said plates on said rail tie along a pair of guides one for each rail seat before and during attaching and securing.

27. The method according to claim 24 wherein said positioning includes positioning said rail plates on said rail tie adjacent a pair of guides and said attaching includes partially driving fasteners into said rail tie through openings in said rail plates while said rail seats engage said guides.

28. The method according to claim 27 wherein aligning continues through said securing.

29. The method according to claim 24 wherein said aligning includes conveying said rail seats of said plates on said rail tie along a pair of guides one for each rail seat before attaching and securing.

30. The method according to claim 29 wherein aligning continues through said securing.

31. The method of claim 24 including aligning said rail tie transversely on said path.

* * * * *